US011674724B2

(12) United States Patent
Zhu et al.

(10) Patent No.: US 11,674,724 B2
(45) Date of Patent: Jun. 13, 2023

(54) AIR SOURCE $CO_2$ HEAT PUMP SYSTEM FOR PREVENTING EVAPORATOR FROM FROSTING BY USING HEAT OF HEAT REGENERATOR

(71) Applicants: Tsinghua University, Beijing (CN); Shanxi Research Institute For Clean Energy, Tsinghua University, Shanxi (CN)

(72) Inventors: Yinhai Zhu, Beijing (CN); Peixue Jiang, Beijing (CN); Conghui Li, Beijing (CN)

(73) Assignees: Tsinghua University, Beijing (CN); Shanxi Research Institute For Clean Energy, Tsinghua University, Shanxi (CN)

( * ) Notice: Subject to any disclaimer, the term of this patent is extended or adjusted under 35 U.S.C. 154(b) by 24 days.

(21) Appl. No.: 17/585,425

(22) Filed: Jan. 26, 2022

(65) Prior Publication Data

US 2022/0243960 A1 Aug. 4, 2022

(30) Foreign Application Priority Data

Jan. 30, 2021 (CN) ..... 202110131222.7

(51) Int. Cl.

| | |
|---|---|
| ***F25B 47/00*** | (2006.01) |
| ***F25B 9/00*** | (2006.01) |
| ***F25B 40/00*** | (2006.01) |
| ***F25D 21/12*** | (2006.01) |

(52) U.S. Cl.

CPC ..... *F25B 47/006* (2013.01); *F25B 9/008* (2013.01); *F25B 40/00* (2013.01); *F25D 21/12* (2013.01); *F25B 2309/06* (2013.01); *F25B 2400/05* (2013.01); *F25B 2400/054* (2013.01)

(58) Field of Classification Search

CPC ..... F25B 9/008; F25B 43/006; F25B 47/006; F25B 47/02; F25B 2400/05; F25D 21/12; F28D 20/021

See application file for complete search history.

(56) References Cited

U.S. PATENT DOCUMENTS 2,693,682 A * 11/1954 Winger ..... F25D 21/12 33/1 HH
2,885,866 A * 5/1959 Hutchinson ..... F25D 21/12 165/145
3,367,131 A * 2/1968 Foessl ..... F25D 21/002 62/278

(Continued)

*Primary Examiner* — Christopher R Zerphey
(74) *Attorney, Agent, or Firm* — Patterson + Sheridan, LLP

(57) ABSTRACT

The present disclosure relates to the technical field of heat pumps, in particular to an air source $CO_2$ heat pump system for preventing an evaporator from frosting by using heat of a heat regenerator. The air source $CO_2$ heat pump system mainly includes an air source heat pump system, a regenerative heat exchange tank and a cooling pump. Through the regenerative heat exchange tank, on the one hand, the temperature drop of regenerative heat of the system is further increased and throttling loss is reduced; on the other hand, the heat generated by the regenerative temperature drop is configured for heat storage used for defrosting, and configured for overheating temperature rise.

2 Claims, 3 Drawing Sheets

(56) References Cited

U.S. PATENT DOCUMENTS

| | | | | | |
|---|---|---|---|---|---|
| 5,165,250 | A * | 11/1992 | Nagatomo | F25B 13/00 | 62/158 |
| 6,318,107 | B1 * | 11/2001 | Pandaru | F28F 3/12 | 62/118 |
| 6,679,321 | B2 * | 1/2004 | Jin | F28D 20/02 | 62/238.7 |
| 6,701,731 | B2 * | 3/2004 | Aikawa | F25B 41/00 | 62/437 |
| 7,685,839 | B2 * | 3/2010 | Gu | F25B 41/37 | 62/503 |
| 9,464,831 | B2 * | 10/2016 | Lemee | F28D 7/04 | |
| 9,482,445 | B2 * | 11/2016 | Wang | F25B 40/00 | |

* cited by examiner

AIR SOURCE $CO_2$ HEAT PUMP SYSTEM FOR PREVENTING EVAPORATOR FROM FROSTING BY USING HEAT OF HEAT REGENERATOR

CROSS REFERENCE TO RELATED APPLICATION

This patent application claims the benefit and priority of Chinese Patent Application No. 202110131222.7 filed on Jan. 30, 2021, the disclosure of which is incorporated by reference herein in its entirety as part of the present application.

TECHNICAL FIELD

The present disclosure relates to the technical field of heat pumps, in particular to an air source $CO_2$ heat pump system for preventing evaporator from frosting by using heat of heat regenerator.

BACKGROUND ART

In order to improve the level of cleanness of heating in northern regions and reduce the emission of air pollutants, 10 departments such as the National Development and Reform Commission and the National Energy Administration have formulated "Plan for Clean Heating in Winter in Northern Regions (2017-2021)". The Plan points out that the area heated electrically would reach 1,500,000,000 square meters by 2021, including 500,000,000 square meters heated by heat pumps. In March 2018, heat pump technology was selected and recorded into "Promotion List of National Key Energy-Saving and Low-Carbon Technologies" recently released by the National Development and Reform Commission, which is regarded as a key energy-saving technology to be promoted. Traditional Freon working medium has high global warming potential (GWP) and causes strong greenhouse effect. Use of natural working medium represented by $CO_2$ is an inevitable trend to deal with increasingly serious climate problems.

Compared with the traditional Freon heat pump, the $CO_2$ heat pump heats in a sensible heat release mode. The change of return water temperature has a great impact on the system performance. In practical engineering, the use of heat pumps for heating often leads to the problem of "pulling a small carriage by a big horse" between the selected system and the demands of heat loads. For constant frequency heat pump units, they will frequently start and stop, which leads to increased energy consumption, large start and stop noise and can easily cause damage to the system. For the variable frequency heat pump units, they may work under partial loads for a long time, and the change of load gradually increases the return water temperature of the system, which attenuates the system performance seriously, has large power consumption and poor energy-saving effect.

In addition, the frosting of the air source heat pump under low temperature and high humidity conditions restricts it from high-efficient operation. Because of continuous accumulation of frost layer on the surface of the air-cooled evaporator, the suction pressure, the discharge pressure and the heating capacity continuously decrease, while the power consumption continuously increases, thereby leading to reduced system performance, poor heating capacity, and even malfunction of the units.

Therefore, poor system performance and frosting under variable loads are urgent problems to be solved for the stable and efficient operation of the air source $CO_2$ heat pump.

SUMMARY

An object of the present disclosure is to provide an air source $CO_2$ heat pump system for preventing an evaporator from frosting by using heat of a heat regenerator, which, by means of a regenerative heat exchange tank. The temperature of $CO_2$ at the expansion valve inlet can be further reduced, and the released heat can be used to prevent evaporator from frosting and increase the suction temperature of the compressor, so as to solve the problem of performance degradation caused by system frosting and variable load performance fluctuations The present disclosure provides an air source $CO_2$ heat pump system for preventing an evaporator from frosting by using heat of a heat regenerator, which includes an air source heat pump system, a regenerative heat exchange tank and a cooling pump. The air source heat pump system includes a compressor, a gas cooler, an expansion valve, an air-cooled evaporator, a drying filter and a gas-liquid separator. A tank body of the regenerative heat exchange tank is filled with a phase change material, a tube-in-tube internal heat exchanger and a cooling liquid heat exchange tube of single-spiral finned tube type are provided within the tank body of the regenerative heat exchange tank. The tube-in-tube internal heat exchanger and the cooling liquid heat exchange tube of single-spiral finned tube type are arranged at intervals in a spiral mode; and an inner tube is arranged in the tube-in-tube internal heat exchanger.

An outlet of the gas cooler is connected with a high-pressure fluid inlet of the tube-in-tube internal heat exchanger in the regenerative heat exchange tank, and a low-pressure fluid outlet of the tube-in-tube internal heat exchanger in the regenerative heat exchange tank is connected with an outlet of the gas cooler through the gas-liquid separator and the compressor.

A cooling liquid inlet of the cooling liquid heat exchange tube of single-spiral finned tube type in the regenerative heat exchange tank, a high-temperature cooling liquid channel of the air-cooled evaporator and a cooling liquid outlet of the cooling liquid heat exchange tube of single-spiral finned tube type forms a cooling liquid circulation circuit, and the cooling pump is arranged at the cooling liquid circulation circuit close to the cooling liquid outlet.

A high-pressure fluid outlet of the tube-in-tube internal heat exchanger in the regenerative heat exchange tank, a refrigerant channel of the air-cooled evaporator and a low-pressure fluid inlet of the tube-in-tube internal heat exchanger form a low-pressure heat regeneration circulation circuit; and the drying filter and the expansion valve are arranged in sequence at the low-pressure heat regeneration circulation circuit close to the high-pressure fluid outlet.

The air source $CO_2$ heat pump system for preventing evaporator from frosting by using heat of a heat regenerator, proposed by the present disclosure, has the following advantages.

In the air source $CO_2$ heat pump system for preventing evaporator from frosting by using heat of a heat regenerator, by means of the regenerative heat exchange tank, on the one hand, the temperature drop of regenerative heat of the system is further increased and throttling loss is reduced, which improves the system performance; on the other hand, the heat generated by the temperature drop of regenerative heat is configured for heat storage used for defrosting, and for overheating temperature rise, so as to avoid a too big degree of superheat caused by using all of the heat for overheating temperature rise and so as to prevent the system performance from attenuation, meanwhile heat is provided for the evaporator to prevent frosting. The air source $CO_2$ heat pump system of the present disclosure combines the regenerative heat exchange tank with the air source $CO_2$ heat pump, which effectively improves the performance of the air source $CO_2$ heat pump under variable load conditions, solves the problem of frosting on the evaporator surface, and achieves stable and efficient heating of the units. Moreover, the regenerative heat exchange tank of the present disclosure has simple and compact structure and is economical, which is conducive to popularization and application.

List of reference numbers: 1 compressor, 2 gas cooler, 3 regenerative heat exchange tank, 4 drying filter, 5 expansion valve, 6 air-cooled evaporator, 7 gas-liquid separator, 8 cooling pump, 9 outer fin of heat exchange tube, 10 tube-in-tube internal heat exchanger, 11 high-pressure fluid inlet, 12 low-pressure fluid outlet, 13 cooling liquid inlet, 14 low-pressure fluid inlet, 15 cooling liquid outlet, 16 closure head, 17 high-pressure fluid outlet, 18 cooling liquid heat exchange tube of single-spiral finned tube type, 19 tank body, 20 low-temperature and low-pressure refrigerant, 21 supercritical fluid, 22 high-temperature cooling liquid channel, 23 high-temperature cooling liquid inlet, 24 high-temperature cooling liquid outlet, 25 refrigerant channel, 26 refrigerant outlet, 27 refrigerant inlet, 28 air-cooled evaporator fin.

DETAILED DESCRIPTION OF THE EMBODIMENTS

Figure 1:
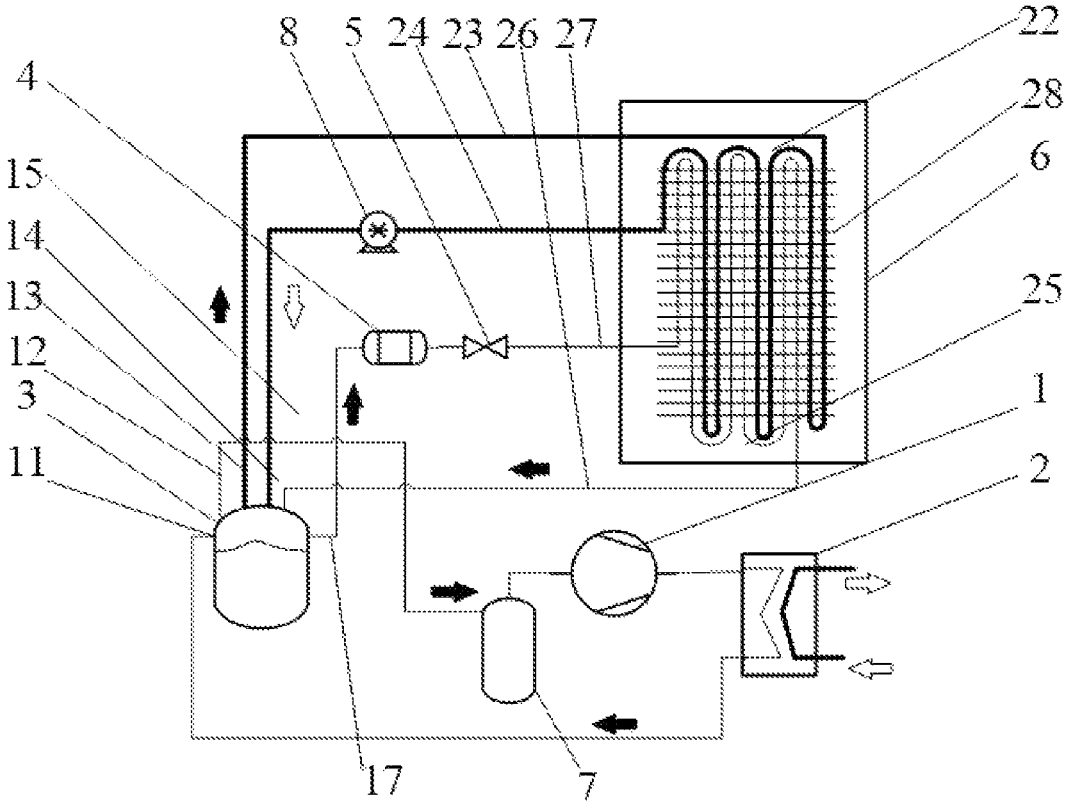
FIG. 1 is a schematic diagram of an air source $CO_2$ heat pump system for preventing evaporator from frosting by using heat of a regenerator, according to the present disclosure.
Figure 2:
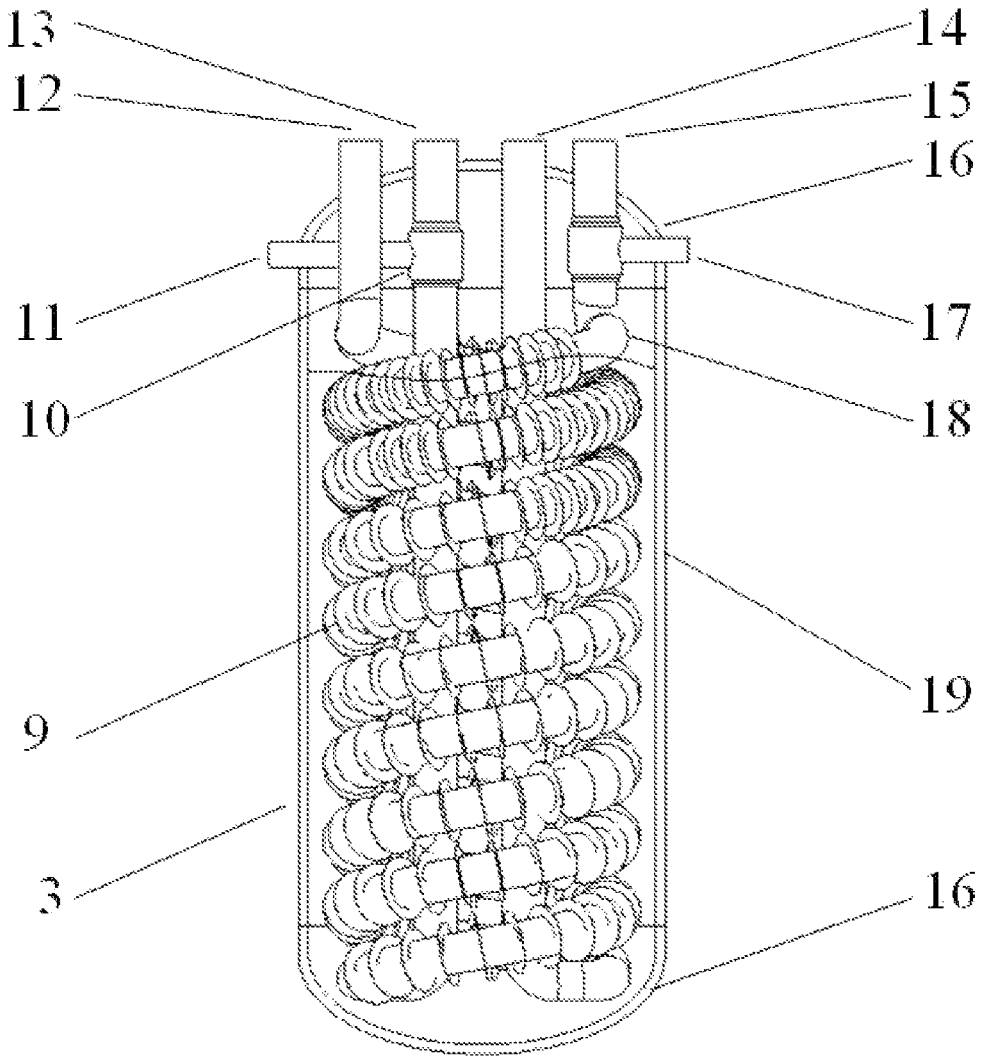
FIG. 2 is a schematic structural diagram of a regenerative heat exchange tank in the air source CO 2 heat pump system shown in FIG. 1.
Figure 3:
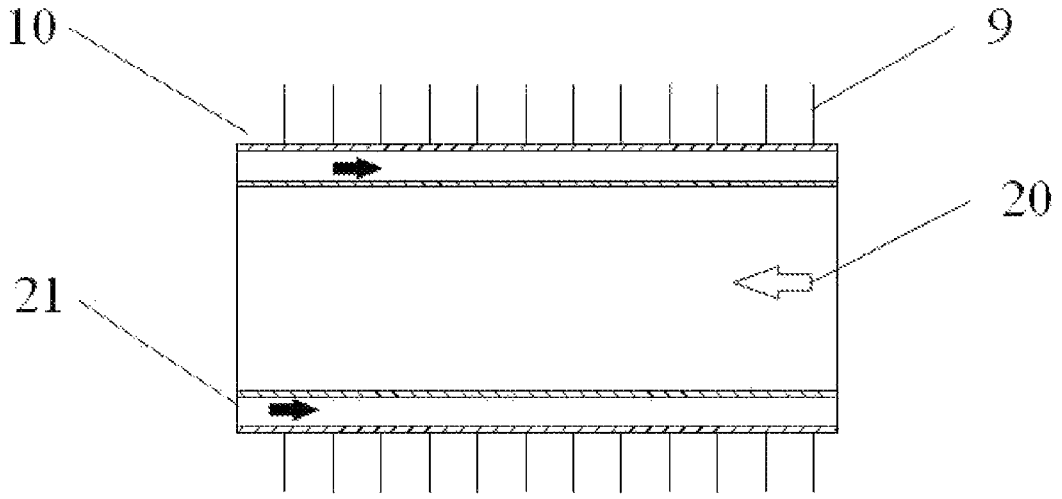
FIG. 3 is a schematic cross-sectional view of a tube-in-tube internal heat exchanger in the regenerative heat exchange tank of FIG. 2.

A structure of the air source $CO_2$ heat pump system for preventing evaporator from frosting by using heat of a heat regenerator, provided by the present disclosure, is shown in FIG. 1. The air source $CO_2$ heat pump system includes an air source heat pump system, a regenerative heat exchange tank 3 and a cooling pump 8. The air source heat pump system includes a compressor 1, a gas cooler 2, an expansion valve 5, an air-cooled evaporator 6, a drying filter 4 and a gas-liquid separator 7. The structure of the regenerative heat exchange tank 3 is shown in FIG. 2. The tank body 19 of the regenerative heat exchange tank 3 is filled with a phase change material. A tube-in-tube internal heat exchanger 10 and a cooling liquid heat exchange tube of single-spiral finned tube type 18 are provided within the tank body 19 of the regenerative heat exchange tank 3. The tube-in-tube internal heat exchanger 10 and the cooling liquid heat exchange tube of single-spiral finned tube type 18 are installed at intervals, in a spiral mode. The structure of the tube-in-tube internal heat exchanger 10 is shown in FIG. 3, and is provided with an inner tube therein.

An inlet of the gas cooler 2 is connected with a high-pressure fluid inlet 11 of the tube-in-tube internal heat exchanger 10 in the regenerative heat exchange tank 3, and a low-pressure fluid outlet 12 of the tube-in-tube internal heat exchanger 10 in the regenerative heat exchange tank 3 is connected with an outlet of the gas cooler 2 through the gas-liquid separator 7 and the compressor 1.

A cooling liquid inlet 13 of the cooling liquid heat exchange tube of single-spiral finned tube type 18 in the regenerative heat exchange tank 3, a high-temperature cooling liquid channel 22 of the air-cooled evaporator 6 and a cooling liquid outlet 15 of the cooling liquid heat exchange tube of single-spiral finned tube type 18 form a cooling liquid circulation circuit, and the cooling pump 8 is arranged at the cooling liquid circulation circuit close to the cooling liquid outlet 15.

A high-pressure fluid outlet 17 of the tube-in-tube internal heat exchanger 10 in the regenerative heat exchange tank 3, a refrigerant channel 25 of the air-cooled evaporator 6 and a low-pressure fluid inlet 14 of the tube-in-tube internal heat exchanger 10 form a low-pressure heat regeneration circulation circuit; and the drying filter 4 and the expansion valve 5 are arranged in sequence at the low-pressure heat regeneration circulation circuit close to the high-pressure fluid outlet 17.

The working principle and working process of the air source $CO_2$ heat pump system for preventing evaporator from frosting by using heat of a heat regenerator are described below in detail in combination with the accompanying drawings.

The air source $CO_2$ heat pump system of the present disclosure mainly includes a regenerative heat exchange tank, a cooling liquid circulation system and an air source heat pump system. The air source heat pump system mainly includes the compressor 1, the gas cooler 2, the expansion valve 5, the air-cooled evaporator 6, the drying filter 4, the gas-liquid separator 7 and connecting tubes. The regenerative heat exchange tank 3 mainly includes the tube-in-tube internal heat exchanger 10, the cooling liquid heat exchange tube of single-spiral finned tube type 18, the tank body 19, a closure head 16, and outer fins of heat exchange tube 9. The cooling pump 8 drives the cooling liquid to flow in the air-cooled evaporator 6 and the cooling liquid heat exchange tube of single-spiral finned tube type 18 in the regenerative heat exchange tank 3 to form the cooling liquid circulation system. When the air source $CO_2$ heat pump system is operated in the heating mode, the supercritical fluid 21 generated by cooling the refrigerant in the gas cooler 2 by the cooling medium (air, water, etc.) is further subcooled through the regenerative heat exchange tank 3 to achieve a large temperature drop of the regenerative heat, and one part of the heat is used for the superheat temperature rise of the low-temperature and low-pressure refrigerant 20, and the other part of the heat is stored through the phase change material so as to prevent the air-cooled evaporator 6 from frosting. The air-cooled evaporator 6 is made of copper tubes and aluminum fins, and is provided with multiple rows of tubes. The outermost row of tubes form the high-temperature cooling liquid channel 22 provided with an inlet 23 and an outlet 24 for the high-temperature cooling liquid (the type of cooling liquid is not limited; water, heat transfer oil and Freon are preferred). The other rows of tubes are refrigerant channels 25. The refrigerant enters the air-cooled evaporator 6 through the refrigerant inlet 27 to exchange heat with the external environment and become saturated steam.

An operation mode of the air source $CO_2$ heat pump system of the present disclosure is provided as follows. $CO_2$ working medium is compressed into the high temperature and high pressure status after passing through the compressor 1, and then enters the gas cooler 2 to exchange heat with the cooling medium. The cooled supercritical fluid 21 enters the tube-in-tube regenerator 10 through the high-pressure fluid inlet 11 of the heat storage heat exchange tank 3 to exchange heat with the $CO_2$ working medium 20 that is the phase change material and has low temperature and low pressure, to realize temperature drop of the regenerative heat. The fluid 21 then flows out of the high-pressure fluid outlet 17, passes through the drying filter 4 and is throttled into a low-temperature and low-pressure two-phase fluid by the expansion valve 5. Then, the two-phase fluid enters the refrigerant channel 25 in the air-cooled evaporator 6 to absorb the heat in the environment so as to become a $CO_2$ working medium 20 with low-temperature and low-pressure. The $CO_2$ working medium 20 with low-temperature and low-pressure flows out from the refrigerant outlet 26 of the air-cooled evaporator 6, and enters the tube-in-tube internal heat exchanger 10 through the low-pressure fluid inlet 14 of the regenerative heat exchange tank 3 for being heated, so as to become superheated steam. The superheated steam then flows out of the low-pressure fluid outlet 12, and finally enters the compressor 1 through the gas-liquid separator 7 to be compressed into a supercritical fluid with high temperature and high pressure. The cycle can be repeated such that heat can be generated continuously. At the same time, it is determined, through the control program, whether the units are operated under frosting condition. If so, the cooling pump 8 drives the cooling liquid to enter the regenerative heat exchange tank 3 through the cooling liquid inlet 13 to exchange heat with the phase change material. The heated cooling liquid enters the outermost high-temperature cooling liquid channel 22 of the air-cooled evaporator 6 through the cooling liquid outlet 15 to provide the storage heat to a surface of the evaporator, so that the surface temperature is higher than the crystallization temperature of the droplets, so as to achieve the purpose of preventing the air-cooled evaporator 6 from frosting.

In the system of the present disclosure, the phase change material in the regenerative heat exchange tank 3 is a phase change material with appropriate phase change temperature and relatively large phase change enthalpy, such as phase change paraffin.

In one embodiment of the system, the gas cooler 2 used is produced by Hangzhou Shenshi heat exchanger Co., Ltd., and the product model is SS-0225GN-U/SS-0050GN-U. The drying filter 4 used is produced by Parker company and the product model is PKHE-084S-CDH. The expansion valve 5 used is produced by Japan Saginomiya company, and the product model is JKV-24D. The air-cooled evaporator 6 used is produced by Jiangsu Fuyuanda Thermal Technology Co., Ltd. and the product model is φ 9.52-4*36*1450. The gas-liquid separator 7 used is produced by Parker company, and the product model is PKHQ-22-CDH. The cooling pump 8 used is produced by Taizhou Fujiwara Tools Co., Ltd., and the rated flow is 10 L/min.

Figure 4:
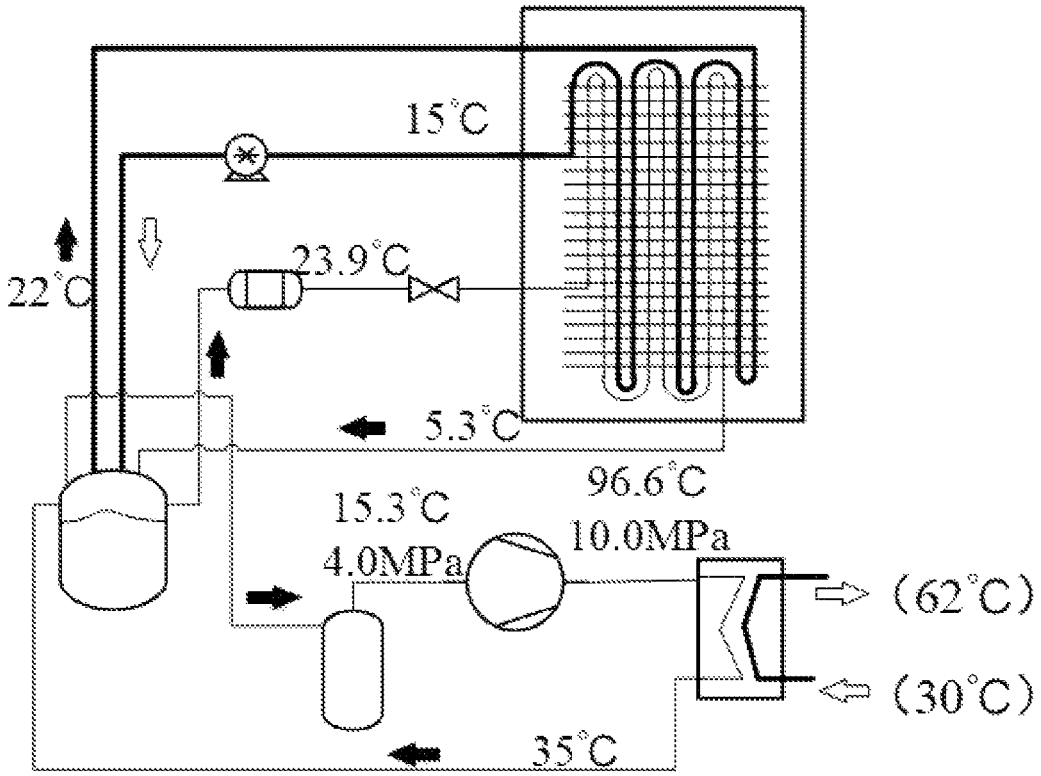
FIG. 4 is a schematic structural diagram of an embodiment according to the present disclosure.

The parameters of one embodiment of the air source $CO_2$ heat pump system of the present disclosure are shown in FIG. 4. The known parameters are provided as follows: ambient temperature and humidity: 7° C./6° C.; cooling water parameters: volume flow rate G=0.54 $m^3$/h; inlet temperature $T_{W,\ in}$=30° C.; specific heat capacity of water: $C_P$=4.2 kJ/(kg·° C.); parameters of the heat pump system: suction and discharge pressure 4 MPa/10 MPa, refrigerant flow rate m=0.1 kg/s, degree of superheat Δ=10K.

Heating mode: without considering the pressure loss, the enthalpy value of each point can be obtained through MATLAB simulation calculation.

| 1 | 1' | 2 | 3 | 3" | 4 |
|---|---|---|---|---|---|
| 427.25 kJ/kg | 445.66 kJ/kg | 498.83 kJ/kg | 290.19 kJ/kg | 253.36 kJ/kg | 253.36 k /kg |

Heat pump heating capacity $Q_1$=m ($h_2$−$h_3$)=20.86 kW.

Power consumption of compressor: W=m ($h_2$−$h_{1'}$)=5.32 kW.

Performance of heat pump system COP=$Q_1$/W=20.86/5.32=3.92.

Phase change storage heat: $Q_2$=m ($h_3$−$h_3$")−m ($h_{1'}$−h1)=1.84 kW.

Defrosting mode: after 1 hour of operation, a frosting thickness reaches 0.18 mm, and the heat required to prevent frosting: Q=mc_PΔt+m×r=2664 kJ.

Heat provided by storage heat: $Q_{storage\ heat}$=3600×$Q_2$=6624 kJ, and its phase change storage heat can meet the heat required to prevent frosting.

The heat from the internal heat exchanger in the present disclosure is used to improve the surface temperature of the evaporator so that the surface temperature cannot reach the frosting condition, so as to produce the effect of preventing frosting, the system can also operate stably and efficiently under frosting conditions.

What is claimed is:

1. An air source $CO_2$ heat pump system for preventing an evaporator from frosting by using heat of a heat regenerator, comprising an air source heat pump system, a regenerative heat exchange tank and a cooling pump; the air source heat pump system comprises a compressor, a gas cooler, an expansion valve, an air-cooled evaporator, a drying filter and a gas-liquid separator; a tank body of the regenerative heat exchange tank is filled with a phase change material, a tube-in-tube internal heat exchanger and a cooling liquid heat exchange tube of single-spiral finned tube type are provided within the tank body of the regenerative heat exchange tank, the tube-in-tube internal heat exchanger and the cooling liquid heat exchange tube of single-spiral finned tube type are arranged at intervals in a spiral mode; and an inner tube is arranged in the tube-in-tube internal heat exchanger;

an outlet of the gas cooler is connected with a high-pressure fluid inlet of the tube-in-tube internal heat exchanger in the regenerative heat exchange tank, and a low-pressure fluid outlet of the tube-in-tube internal heat exchanger in the regenerative heat exchange tank is connected with an outlet of the gas cooler through the gas-liquid separator and the compressor;

a cooling liquid inlet of the cooling liquid heat exchange tube of single-spiral finned tube type in the regenerative heat exchange tank, a high-temperature cooling liquid channel of the air-cooled evaporator and a cooling liquid outlet of the cooling liquid heat exchange tube of single-spiral finned tube type form a cooling liquid circulation circuit, and the cooling pump is arranged at the cooling liquid circulation circuit close to the cooling liquid outlet;

a high-pressure fluid outlet of the tube-in-tube internal heat exchanger in the regenerative heat exchange tank, a refrigerant channel of the air-cooled evaporator and a low-pressure fluid inlet of the tube-in-tube internal heat exchanger form a low-pressure heat regeneration circulation circuit; and the drying filter and the expansion valve are arranged in sequence at the low-pressure heat regeneration circulation circuit close to the high-pressure fluid outlet.

2. The air source $CO_2$ heat pump system according to claim 1, wherein the phase change material is paraffin.

* * * * *